United States Patent [19]

Kessing et al.

[11] Patent Number: 4,998,869

[45] Date of Patent: Mar. 12, 1991

[54] APPARATUS FOR MAKING PARTICLE MATS WITH UNIFORM WEIGHT DISTRIBUTION

[75] Inventors: Reinhard Kessing; Friedrich Schröder, both of Springe, Fed. Rep. of Germany

[73] Assignee: Bison-Werke Bähre & Greten GmbH & Co. KG, Springe, Fed. Rep. of Germany

[21] Appl. No.: 334,663

[22] Filed: Apr. 6, 1989

[30] Foreign Application Priority Data

Apr. 7, 1988 [DE] Fed. Rep. of Germany ..... 3811677

[51] Int. Cl.[5] ..... B27N 3/02; B27N 3/04

[52] U.S. Cl. ..... 425/81.1; 264/113; 264/118; 425/83.1; 425/140; 425/145

[58] Field of Search ..... 425/81.1, 82.1, 83.1, 425/80.1, 140, 145; 404/101; 414/174, 209; 264/109, 118, 113

[56] References Cited

U.S. PATENT DOCUMENTS

| | | | |
|---|---|---|---|
| 2,241,051 | 5/1941 | Berger | 425/80.1 |
| 2,441,169 | 5/1948 | Roman | 425/80.1 |
| 2,635,301 | 4/1953 | Schubert et al. | 425/83.1 |
| 2,689,975 | 9/1954 | Leng | 425/80.1 |
| 2,822,024 | 2/1958 | Himmelheber et al. | 264/109 |

FOREIGN PATENT DOCUMENTS

| | | |
|---|---|---|
| 676710 | 12/1963 | Canada . |
| 151689 | 11/1962 | U.S.S.R. . |

*Primary Examiner*—James C. Housel
*Attorney, Agent, or Firm*—Townsend and Townsend

[57] ABSTRACT

An apparatus for making more uniform the distribution in weight per unit area of a one layer or multi-layer mat for the manufacture of wooden chipboard, wooden fiberboard or like boards includes a reverse brushing unit extending over the width of the mat is associated with the mat carrier (1) which is fed by at least one scattering head. A distributor unit (4) disposed in the backward scattering path for the mat particles is inserted in front of this reverse brushing unit (3) in the direction of movement of the mat (2) for the variable deflection of the incident mat particles.

12 Claims, 1 Drawing Sheet

APPARATUS FOR MAKING PARTICLE MATS WITH UNIFORM WEIGHT DISTRIBUTION

Figure 1:
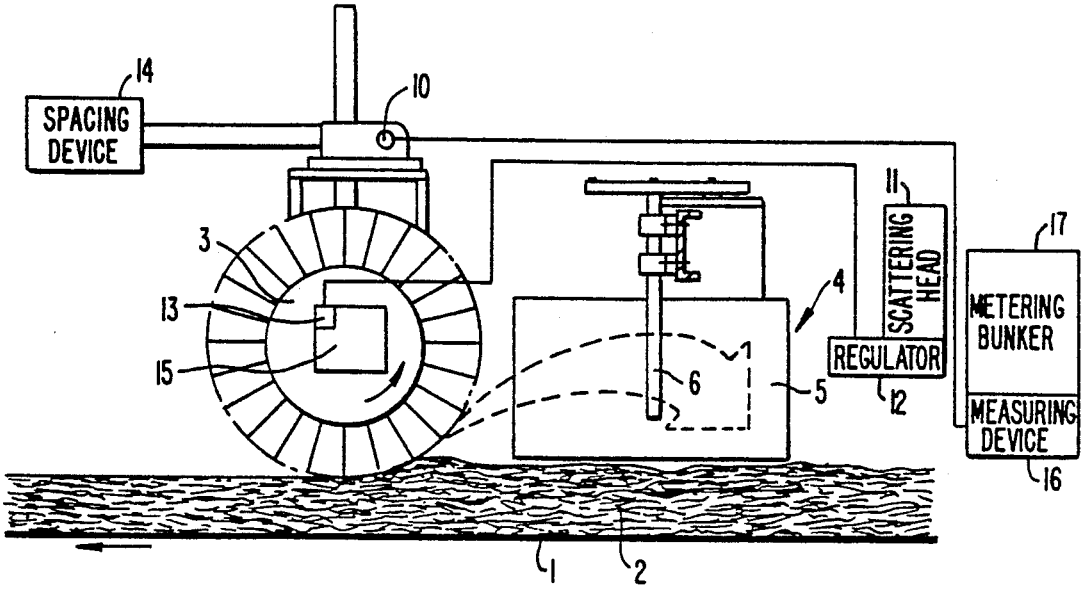

The invention relates to an apparatus for evening out the distribution of weight per unit area of a on-layer or multi-layer mat for the manufacture of board-like products in the form of wooden chipboard, wooden fiberboard or the like.

In practice considerable importance is attached to achieving a uniform distribution of weight per unit area in the transverse direction of mats for the manufacture of chipboard, fiberboard or like boards. Accordingly it is also already known to use levelling devices both during the formation of the premat and also with mats which are already located on the mat carrier, with the levelling devices taking the form of brushes or rakes in combination with feedback units which transport mat particles (or fleece particles) which collect in the form of a heap in the front of the brush or rake unit back into the metering bunker.

The object underlying the invention is to develop an apparatus of the initially named in such a way that a particularly good evening out of the distribution of weight per unit area over the width of the mat is achieved, even with multi-layer mats, without the requirement to return material, and to simultaneously ensure the best possible levelling of the particular mat surface.

This object is satisfied in accordance with the invention essentially in that at least one backward brushing unit which extends over the width of the mat is associated with the mat carrier to which mat particles are fed by at least one scattering head; and in that a distributor unit disposed in the backward scattering path for the mat particles is inserted in front of this reverse brushing unit in the direction of movement of the mat for the variable deflection of the incident mat particles.

Through the combination of a reverse brushing unit, which brings about a projection scattering effect, with a distribution unit which distributes the incident and in particular the larger mat particles over the width of the mat while evening them out, one not only receives a levelling effect and also an evening out of the weight per unit area but rather a certain pressure effect is also exerted on the mat by the reverse brushing unit which ensures that any spikiness of the respective mat layer is removed and a correspondingly flat mat surface is provided. This is particularly advantageous when the reverse brushing unit acts on a mat central layer, since in this case a flat central layer can be achieved which has been made uniform and which is suited in the best possible manner for receiving the respective covering layer. This ensures that after a pressing process no regions of different thickness are present between the central layer and the covering layer, so that the danger of grinding through during a later covering layer grinding process does not exist.

The apparatus of the invention furthermore ensures that any valleys or troughs which may be present in the mat are filled out, and that mixed chips are present homogenously in a random position over the entire width of the mat. This leads to the advantage that boards made of such mats have particularly no tendency to distort.

The reverse brushing unit expediently comprises a reverse brushing scattering roller which extends over the width of the mat, with its axle extending parallel to the mat carrier and perpendicular to the direction of movement of the mat carrier. The axle and thus the reverse brushing scattering roller is preferably driven at high speed, with an expedient speed of rotation lying for example at 300 revolutions per minute.

The reverse brushing scattering roller which exerts the function of a projection roller is expediently adjustable with respect to its spacing from the mat carrier, so that a simple adaptation is possible to the circumstances of the particular fleece formation.

The distributor unit comprises several oscillatable baffles, i.e. suspended flaps, which are arranged alongside one another with the axes of these baffles preferably extending perpendicular to the mat carrier and with the baffles being coupled to a common drive in phase or at least in part phase-displaced.

These suspended flaps ensure that those mat particles which are not pressed flat and compressed by the reverse brushing scattering roller, but are rather projected backwardly in the direction of the suspended flaps, are deflected and distributed in such a way that these particles are distributed irregularly over the width of the mat while avoiding peak and valley formation.

In accordance with a further development of the invention the quantity dispensed by the scattering head which is inserted in front of the reverse brushing unit is regulated in dependence on the power consumption of the reverse brushing unit, whereby it is possible to keep the volume of the hill which forms in front of the reverse brushing unit approximately constant.

Further advantageous developments of the invention are set forth in the subordinate claims.

Figure 2:
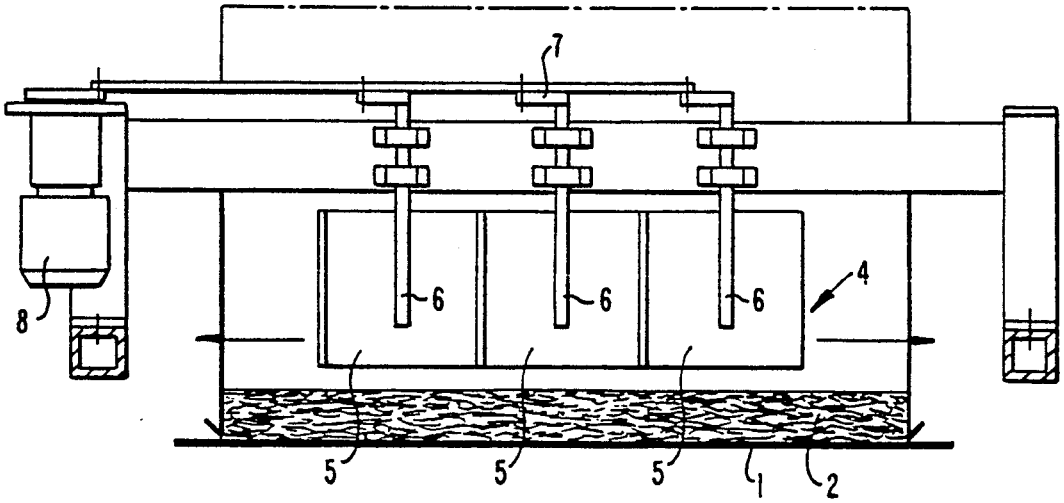

An embodiment of the invention will now be described in the following with reference to the drawing in which are shown:

FIG. 1 a schematic sideview of the inventive combination of a reverse brushing unit with a distribution unit, and FIG. 2 a front view of the distribution unit of FIG. 1.

FIG. 1 shows a mat carrier 1 moving in the direction of the arrow with a mat 2 arranged thereon. This mat 2 has an irregular surface contour having peaks and valleys in the region before the reverse brushing unit 3.

The reverse brushing unit 3, which consists of a reverse brushing scattering roller with a working width which at least corresponds to the mat width, is so set in its distance from the mat carrier 1 that it is possible to compensate for the surface irregularities of the mat which enters its range of operation.

The reverse brushing scattering roll which is preferably associated with the central layer during mat construction can be vertically adjusted via a motorized drive 10. This height is adjustable and is controlled in dependence upon measurements of weight per unit area of taken by measuring device 16 attached to metering bunker 17. The vertical adjustment is thus matched to the special circumstances of one kind of mat. It is driven at a comparatively high speed. A typical speed of revolution amounts to approximately 300 rpm. This reverse brushing scattering roller exerts a certain pressure on the mat so that the spiky projecting chips are turned over and a levelled flat surface is obtained.

Those mat particles which are thrown by the reverse brushing scattering roller against the direction of movement of the mat 2 in the direction of a distribution unit 4, and are thus practically subjected to a projection scattering effect, impinge, at least to a substantial degree, onto the distributor unit 4 arranged at a predetermined spacing from the reverse brushing unit 3, and are led back from the latter onto the mat while being irregularly deflected again.

FIG. 2 shows the distribution unit 4 in a front view and allows it to be sen that the distributor unit 4 comprises several oscillatable baffles 5 which are arranged alongside one another with their axles 6 extending perpendicular to the mat carrier 1.

These oscillatable baffles 5 are driven in phase or at least partly phase-displaced from a common drive 8, e., are set into pivotal movements.

The cooperation of the reverse brushing scattering roller with the distribution unit 4 ensures that valleys which are present in the mat are uniformly filled out over the width of the mat and the chips thereby adopt irregular random positions which is important for the board which is later manufactured from the mat, since an unordered random position of the chips offers security against undesired warping or distortion of the finished boards.

The distance between the lower edge of the oscillatable baffles 5 and the mat 2 is selected to be as small as possible with it however always being ensured that the oscillatable baffles do not dip into the mat 2 which still has an irregular surface contour.

The distance between the reverse brushing unit 3 and the distribution unit 4 can always be so selected in dependence on the type of mat and the selected speed of rotation of the reverse brushing unit that a best possible distribution of the backwardly projected particles results. This can be derived by tests.

In order to ensure that only a restricted quantity of backwardly scattered particles can collect before the reverse brushing scattering roller the quantity dispensed by the scattering head 11 which is positioned in front of the mat brushing unit is preferably regulated in dependence on the quantity of mat particles which collect in front of the reverse brushing unit. This can expediently be realized in such a way that the power consumption of the reverse brushing unit is determined by the power consumption measuring device 13 and is used as a control parameter for the quantity dispensed by regulator 12 from scattering head 11.

What is claimed is:

1. An apparatus for evening out the distribution of weight per unit area of a one layer or multi-layer mat for the manufacture of board-like products from generally particulate material, the apparatus comprising:

a mat carrier;

means for moving said mat carrier in a longitudinal direction;

at least one scattering head for scattering particles on said mat carrier to form a mat thereon extending in said longitudinal direction, said mat having a surface remote from said mat carrier and a width transverse to said longitudinal direction;

at least one reverse brushing unit which extends over said width of said mat for brushing particles from said surface backwardly relative to said longitudinal direction along a backward scattering path; and a distributor unit disposed in said backward scattering path before said reverse brushing unit as viewed in said longitudinal direction for subjecting mat particles moving along said backward scattering path to a variable deflection.

2. An apparatus in accordance with claim 1, wherein said reverse brushing unit comprises a reverse brushing scattering roller which extends over said width of said mat, said reverse brushing scattering roller having an axis extending parallel to said mat carrier and perpendicular to said longitudinal direction.

3. An apparatus in accordance with claim 2, further comprising means for vertically adjusting said axis of said reverse brushing scattering roller relative to said mat carrier.

4. An apparatus in accordance with claim 2, wherein said reverse brushing scattering roller has an adjustable speed of rotation.

5. An apparatus in accordance with claim 1, wherein said distributor unit comprises several oscillatable baffles arranged alongside one another transverse to said longitudinal direction.

6. An apparatus in accordance with claim 5, wherein said oscillatable baffles are suspended on axles, said axles extending perpendicular to said mat carrier.

7. An apparatus in accordance with claim 5, further comprising means for coupling said oscillatable baffles to a common drive, said baffles being in phase.

8. An apparatus in accordance with claim 5, further comprising means for coupling said oscillatable baffles to a common drive, said baffles being at least partly out of phase.

9. An apparatus in accordance with claim 5, wherein said reverse brushing unit comprises a reverse brushing scattering roller, wherein an adjustable spacing is present between said reverse brushing scattering roller and said oscillatable baffles.

10. An apparatus in accordance with claim 1, further comprising a first scattering head for scattering a central layer of material onto said mat carrier and a second scattering head is provided for scattering an upper covering layer of material onto said central layer, and wherein said reverse brushing unit and said distributor unit are disposed between said first scattering head and said second scattering head.

11. An apparatus in accordance with claim 10, further comprising:

a metering bunker in front of said first scattering head for a central layer, wherein a weight per unit area measuring unit is disposed in said metering bunker; and means for controlling the vertical adjustment of said reverse brushing scattering roller depending on a measurement of said weight per unit area measuring unit.

12. An apparatus in accordance with claim 1, further comprising means for measuring power consumption of said reverse brushing unit and means for regulating a quantity of particles dispensed by said first scattering head depending on said power consumption as measured.

* * * * *